US005450978A

United States Patent [19]

Crisp et al.

[11] Patent Number: 5,450,978

[45] Date of Patent: Sep. 19, 1995

[54] ENVIRONMENT COMPATIBLE STORAGE VESSEL

[75] Inventors: Gilbert M. Crisp; Jack R. Crisp, both of Visalia, Calif.

[73] Assignee: A.G.T. Vault, Visalia, Calif.

[21] Appl. No.: 392,404

[22] Filed: Feb. 22, 1995

Related U.S. Application Data

[63] Continuation of Ser. No. 192,803, Feb. 7, 1994, abandoned, which is a continuation of Ser. No. 889,796, May 28, 1992, abandoned.

[51] Int. Cl.[6] ..... B65D 90/04

[52] U.S. Cl. ..... 220/565; 220/469

[58] Field of Search ..... 220/565, 469, 4.12, 220/429

[56] References Cited

U.S. PATENT DOCUMENTS

| | | | |
|---|---|---|---|
| 4,653,312 | 3/1987 | Sharp | 220/469 X |
| 4,935,943 | 6/1990 | Schweiter et al. | 220/429 X |
| 4,951,844 | 8/1990 | Sharp | 220/469 |
| 4,974,739 | 12/1990 | Gelin | 220/469 X |
| 4,991,613 | 2/1991 | Kaminski et al. | 220/565 X |
| 5,103,996 | 4/1992 | MacGarvey | 220/565 X |
| 5,172,584 | 12/1992 | Thomas | 220/565 X |
| 5,251,473 | 10/1993 | Reese | 220/565 X |
| 5,271,493 | 12/1993 | Hall | 220/469 |

*Primary Examiner*—Steven M. Pollard

*Attorney, Agent, or Firm*—Sixbey, Friedman, Leedom & Ferguson; Dennis B. Haase

[57] ABSTRACT

The present invention, in its most elemental form, comprises an above ground storage vessel for volatile liquids in which an inner storage chamber is formed in proportion to an outer shell, leaving a space between them which is capable of containing up to 110% of the storage capacity of the inner storage chamber, which chamber is completely encapsulated in a volume of a non-conductive particulate medium of a type which has the capacity to entrap up to 45% of its volume of the storage vessel within its boundaries, and which is sufficiently compactible as to be capable of supporting the entire storage vessel and its contents centrally within the confines of a protective outer shell.

11 Claims, 1 Drawing Sheet

ENVIRONMENT COMPATIBLE STORAGE VESSEL

This application is a Continuation of Ser. No. 08/192,803, filed Feb. 7, 1994, now abandoned, which is a Continuation of Ser. No. 07/889,796, filed May 28, 1992, now abandoned.

The present invention relates to vessels for the above ground storage of volatile liquids at ambient temperatures, and more particularly to such vessels which are anti-ballistic, fire and leak resistant, and shock resistant, which, in summary, means a vessel of a type which is considered hazardous, now in complete harmony with the environment.

BACKGROUND OF THE INVENTION

1. Field of the Invention

Since the advent of the horseless carriage, the commercial storage and dispensing of volatile fluids such as gasoline has been accomplished with very little concern. Typically, a steel tank, although more recently, fiber glass, often ranging from as little as 250 gallons to as much as 20,000 gallons, was unceremoniously dumped in a hole in the ground, and a pumping system connected to the tank permitted above ground dispensing of its contents.

Private users, such as, for example, farmers, often put a 55 gallon drum, or other storage vessel, on a stand above ground to permit gravity feed of the fuel.

Above ground storage of volatile fluids posed some unenviable problems, among them the likelihood that some fun loving hunter would find such tanks to be an irresistible target. Of course, those of a more vandalic character found such tanks to be a challenge. As a consequence, such tanks became a very real danger which subterranean tanks simply eliminated.

Moreover, since gravity exerted a constant force on the tanks' contents, leaks were not uncommon, and posed an immediate fire hazard not present in an underground installation.

In the past decade or so the public came to realize that underground tanks, not unlike their above ground counter-parts, corrode, and leak, too. Such leakage, however, goes sublimely unnoticed, unless or until the tank is pulled for one reason of another, or until contamination begins to appear in an adjacent water supply, or in the soil.

As a consequence of the myriad problems associated with the storage of volatile fluids, the Federal and State regulatory authorities have promulgated a definitive set of rules, codes and procedures regulating the installation, storage and dispensing of volatile fluids such as, for example, gasoline.

It is the principal objective of the present invention to provide a storage facility, above ground, which meets and exceeds all of the established criteria for such storage facilities, in the form of a storage vessel which is entirely compatible with the environment.

2. Overview of the Prior Art

Since the regulation of above ground storage of volatile fuels is a relatively new phenomenon, a search of the applicable prior art discloses correspondingly little in the way of proprietary concepts. In recognition of the danger inherent in storing volatile fluids, the use of double walled chambers has become vogue, but in and of itself, passe, for several reasons.

Double walled chambers typically interconnect at several points in order that the inner storage chamber can be supported by the outer chamber. Such interconnecting devices are almost uniformly heat conductive, and commonly electrically conductive. Thus, in the event of a fire, or an electrical strike, such as by lightning, or fallen electrical lines, the contents of the chamber, where there is typically some oxygen present, is a potential grenade.

Other than the convenience of it all, the value of an above ground tank is the ease with which leaks can be detected. However, mere detection is not protection against the leak itself, and concrete bases and shelters are often required to prevent spreading of leaked material, as well as to quell the temptation to shoot at it.

In reference to an essentially non-analogous art, such as in the area of storage of cryogenic fluids, double walled tanks are in common use. Such tanks invariably include insulation in what was before an air space between the walls. The focus of such construction was not for the purpose of preventing disastrous consequences of escaped volatile fuels, but rather to provide insulation in order to preserve the extremely low temperatures at which such liquids are stored.

Such is the import of Bradford U.S. Pat. No. 4,136,493 in which a double walled vessel employs an intermediate insulator material in the form of granulated perlite or vermiculite. Of interest in Bradford is the claim by the inventor that the inner tank is fully supported by the insulation material. However, as is evident in FIGS. 3 and 4 of the patent, there is clear contact of a supportive nature between the platform 19, and the outer shell, which, in Bradford, is the wall of the excavation.

A similar device is disclosed in Hofmann U.S. Pat. No. 3,930,375, which, although earlier in time, embellishes on Bradford by employing a radiation shield and flecks of metal to act as radiation deflectors in the perlite.

Chemically inert cellular materials have been used in storing volatile fuels also, among them, various foams, and at least one effort to use concrete, but these efforts do not offer the spectrum of security and protection afforded by the present invention.

SUMMARY OF THE INVENTION

The present invention, in its most elemental form, comprises an above ground storage vessel for volatile liquids in which an inner storage chamber is formed in proportion to an outer shell, leaving a space between them which is capable of containing up to 110% of the storage capacity of the inner storage chamber, which chamber is completely encapsulated in a volume of a non-conductive particulate medium of a type which has the capacity to entrap up to 45% of its volume of the storage vessel within its boundaries, and which is sufficiently compactible as to be capable of supporting the entire storage vessel and its contents centrally within the confines of a protective outer shell.

In addition to the objective previously articulated it is a further, and more specific objective of the present invention, to provide an above ground storage vessel which is capable of withstanding the impact of a projectile from a thirty-ought-six rifle, without compromising the integrity of the storage chamber of the vessel.

Similarly, it is yet another objective of the present invention to provide a storage vessel for volatile liquids which can be secured, above ground, and meet and exceed all safety and environmental standards regarding leaks, fire, and at least to some extent, earthquakes.

DESCRIPTION OF THE DRAWINGS

Having thus established the environment in which the present invention has particular utility, reference will now be made to the drawings, wherein.

DESCRIPTION OF A PREFERRED EMBODIMENT

Figure 1:
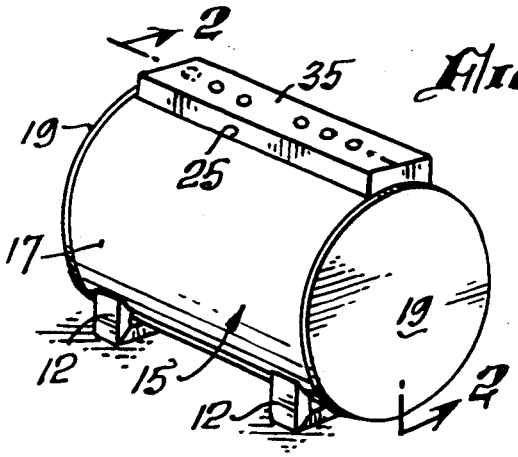
FIG. 1, is a pictorial view of a storage vessel constructed in accordance with the present invention.

With reference now to the sheet of drawing, and, in particular, FIG. 1 thereof, a volatile fuel storage vessel constructed in accordance with the present invention, is illustrated at 10. As is apparent in FIG. 1, the vessel 10 is mounted above ground on support members 12.

The vessel 10, in keeping with one aspect of the invention, comprises an outer shell 15, which is preferably constructed of a steel or steel alloy, although advances in high impact plastics of the type now beginning to be used in vehicle body construction, may soon be a practical substitute.

The outer shell, as illustrated, comprises a cylindrical body member 17, having circular end pieces 19 welded, or otherwise attached at either end. The specific mode of fabrication is not germane to the invention, except to the extent that it is important that there be no pin holes, nor porosity at the joints which could permit fugitive vapors or liquids to escape. Similarly, the specific shape of the vessel is a matter of choice and convenience, and, in fact, vessels constructed in accordance with the present invention have been made in rectangular, as well as cylindrical forms.

Along the uppermost surface of the cylindrical body member 17, there is an access hole defined between longitudinal edges 25 and 27, respectively, of the cylinder 17 and transverse edges 30 and 32. A delivery panel 35 is secured in the access hole, in sealing relation with the surfaces which define the opening, and as shown, is fabricated of concrete, although other suitable materials may also be used.

In practical application, the outer shell 15 is fabricated about an inner, fluid storage chamber 40, which, like the outer shell 15 is of cylindrical configuration, albeit proportionately smaller. Thus, the inner storage chamber 40 has a cylindrical body 42, capped at its respective ends by circular caps 44. The storage chamber 40 may be constructed of any suitable material, although steel appears to be the most practical at this time. The chamber 40 must, of course, be fluid and vapor tight at all seams.

Figure 2:
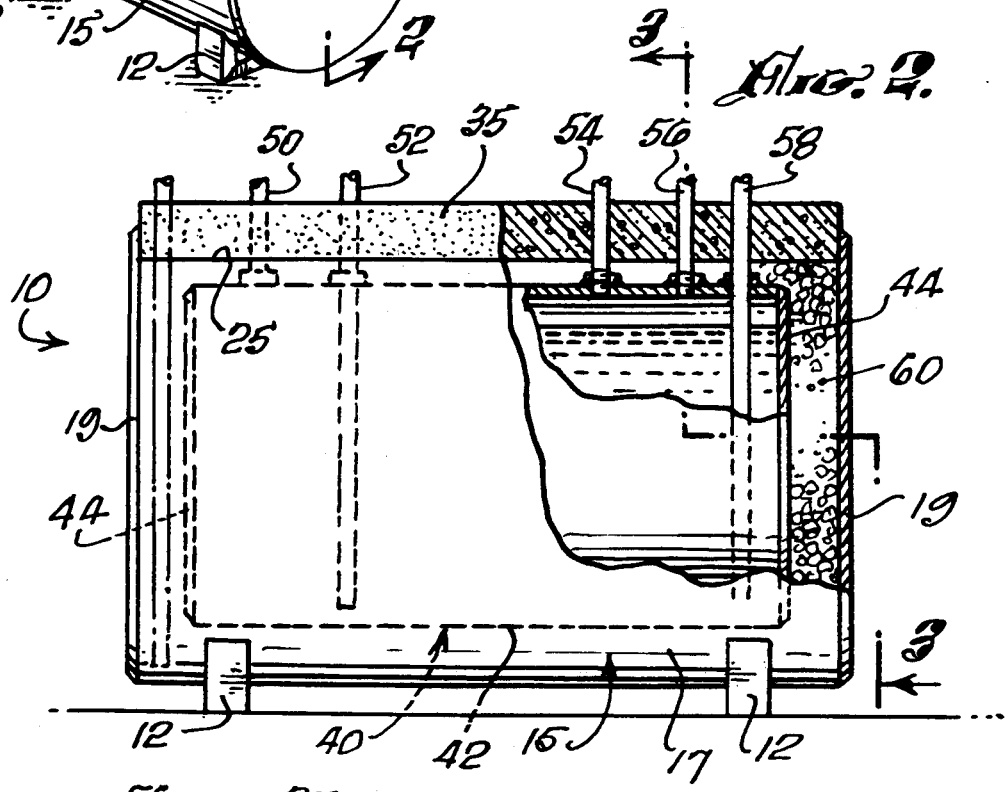
FIG. 2, is a side elevation of the tank of the present invention, partially sectioned to illustrate various novel features thereof.
Figure 3:
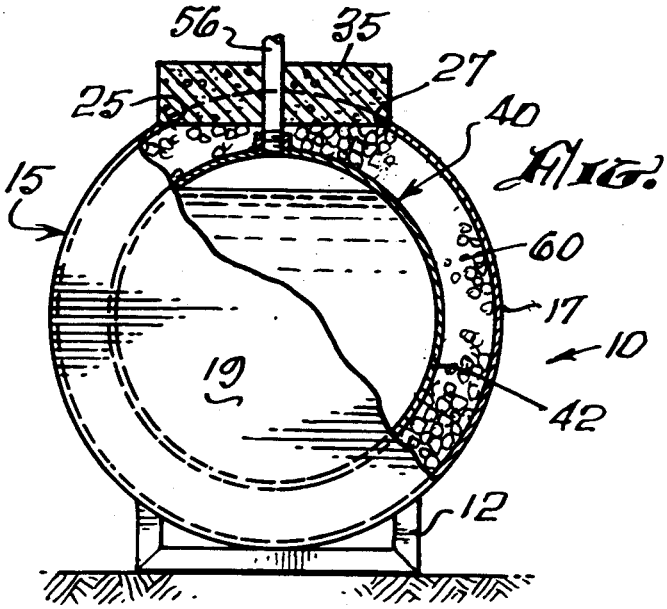
FIG. 3, is an end elevation of the tank of the present invention, again partially sectioned to illustrate still other features of the present invention.

Because the vessel of the present invention provides not only storage but delivery capacity, the cylindrical wall of the inner storage chamber 40 is provided with several orifices which accommodate, respectively, a filler tube 50; a fuel gauge 52; an emergency pressure relief valve 54; a vent to permit replacement air to fill the chamber as fuel is delivered, 56; and a delivery pipe 58. All of the foregoing pipes and gauges pass through the delivery panel 35, as best illustrated in FIG. 2. Once beyond the panel the piping may be routed to fit the specific installation.

It is a significant feature of the present invention that means is provided for supporting the inner storage chamber 40, in as close to a centered, or symmetrical, position as possible within the confines of the outer shell 15 without any direct contact between them.

It is also an important feature of the invention that the space between the inner storage chamber, and the outer shell be of a predetermined volume relative to the volume of the inner support chamber. Specifically, the vessel 10 is designed to provide a space having a volume between the outer shell 15, and the inner storage chamber 40, which is at least equal to 110% of the volume of the inner storage chamber. Thus, in the event of a rupture, or severe leak in the storage chamber, fugitive volatile liquids are completely contained within the outer shell.

Clearly, empty space will not support the inner storage chamber, and as previously discussed, highly specialized support is a feature of the invention. Thus, support is accomplished by encapsulating the inner storage chamber 40 with a jacket 60 of non-conductive, non-degradable, aggregate, of which a coarse sand, or pea gravel, with particle sizes up to ⅜" have been found to be highly effective in accomplishing the objectives of this invention.

In practice, aggregate of the type described is compacted about the inner chamber 40 in the outer shell 15 by suspending the inner chamber 40 within the outer shell 15 and slowly filling the space between them by compacting the aggregate about the entire inner chamber until it literally encapsulates the inner chamber 40 with a jacket 60 of compacted aggregate of a thickness that is substantially uniform, and of a predetermined volume relative to the capacity of the storage chamber.

With the jacket thus formed, several million tiny air spaces, or cells, are created in the jacket, while at the same time providing strong support for the inner chamber 40 and its contents. The jacket 60 material is such that it will absorb as much as 45% of its volume. Thus, in the event of a leak in the wall of the inner chamber 40, the jacket 60 will absorb as much as 45% of its volume without loss of its structural integrity, and the inner storage chamber remains fully supported. It will also be appreciated that any such leakage will spread through the jacket, thereby avoiding the formation of a substantial pocket of volatile material which could pose a fire or explosion hazard.

Finally, any leakage can be detected through a monitoring tube, 62, which permits leak detection throughout various levels in the jacket 60.

The aggregate jacket 60, is insoluble in most petroleum based fluids, and will, therefore, maintain its integrity as the sole means of support for the inner storage chamber in the event of a leak in the inner chamber. The jacket 60 also has a great capacity to absorb energy. Tests performed on a vessel constructed in accordance with the teachings of the present invention, wherein a high powered rifle was fired at the tank 10 of the present invention, demonstrated that while the projectile penetrated the outer shell 15, it was stopped in the aggregate jacket 60.

Finally, the energy absorption capacity of the jacket 60 is of assistance in an earthquake, or in any instance where the vessel 10 is badly shaken. If, for example, the fluid in a partially filled tank were to be put in motion by forces rocking the entire vessel, it would constitute a formidable force, and the jacket 60 is capable of absorbing some of those forces.

In summary, a storage vessel has been described which meets and exceeds all codes and regulations pertaining to the storage of volatile liquids above ground, and especially the ability to contain leakage of fugitive volatile liquids from the inner storage chamber. For the first time, an above ground storage and dispensing vessel is provided as an inexpensive, yet safe alternative to underground storage.

Having thus described the preferred embodiment of the present invention, what is claimed is:

1. An antiballistic, fire resistant above ground storage and dispensing vessel for the storage and delivery of volatile and hazardous liquids that meets and exceeds safety and environmental standards for storing and delivering such liquids, comprising (a) outer shell means located entirely above the surface of the ground for containing leakage of said liquids;

(b) fluid and vapor tight storage chamber means for storing a quantity of a volatile or hazardous liquid, wherein said storage chamber means is supported substantially symmetrically within said outer shell means out of direct contact therewith and spaced inwardly from said outer shell means to form a predetermined volume between said storage chamber means and said outer shell means; and (c) jacket means for supporting said storage chamber means substantially symmetrically within said outer shell means and out of direct contact therewith, said jacket means comprising coarse washed sand capable of passing a ⅜-inch sieve and almost entirely passing a 4,760-micron No. 4 sieve and being predominately retained on a 74-micron No. 200 sieve substantially filling said predetermined volume to encapsulate said storage chamber means.

(d) said jacket means providing the sole support for the storage chamber means within the outer shell means.

2. The storage and dispensing vessel described in claim 1, wherein said predetermined volume is at least 110% of the volume of said storage chamber means.

3. The storage and dispensing vessel described in claim 1, wherein said jacket means is capable of absorbing up to 45% of the volume of said jacket material of liquid stored in said storage chamber means.

4. The storage and dispensing vessel described in claim 1, wherein said outer shell means and said storage chamber means each have a cylindrical configuration and said storage chamber means is proportionately smaller than said outer shell means.

5. The storage and dispensing vessel described in claim 1, further comprising delivery panel means for accommodating the conduits and valves required for the storage and delivery of liquids from said vessel.

6. The storage and dispensing vessel described in claim 1, wherein said outer shell means is formed of a material selected from the group consisting of steel, steel alloys and high impact plastics.

7. The storage and dispensing vessel described in claim 6, wherein said storage chamber means is made of steel.

8. A volatile and hazardous liquid storage vessel which meets and exceeds safety and environmental requirements for the storage of hazardous and volatile liquids completely above the surface of the ground, comprising an interior storage tank supported substantially symmetrically within an exterior shell and out of direct contact therewith, said exterior shell having substantially the same configuration as said interior storage tank so that a substantially uniformly thick annular space is formed between said tank and said shell, wherein said annular space is substantially completely filled with an insulating jacket material comprising coarse washed sand capable of passing a ⅜-inch sieve and almost entirely passing a 4,760-micron No. 4 sieve and being predominately retained on a 74-micron No. 200 sieve, which provides the sole support for said interior storage tank and maintaining said interior storage tank substantially symmetrically positioned within said outer shell and imparts fire resistance and antiballistic characteristics to said storage vessel.

9. The storage vessel described in claim 8, wherein said interior storage tank and said exterior shell each have a cylindrical configuration.

10. The storage vessel described in claim 9, wherein the volume of said annular space is at least 110% of the volume of said interior storage tank.

11. The storage vessel described in claim 10, wherein said interior storage tank is made of steel and said exterior shell is made of a material selected from the group consisting of steel, steel alloys and high impact plastic.

* * * * *